US009333667B2

(12) United States Patent
Kuriki

(10) Patent No.: US 9,333,667 B2
(45) Date of Patent: May 10, 2016

(54) PUNCHING APPARATUS AND PUNCHING METHOD

(71) Applicant: DENSO CORPORATION, Kariya, Aichi-pref. (JP)

(72) Inventor: Ken Kuriki, Kariya (JP)

(73) Assignee: DENSO CORPORATION, Kariya (JP)

( * ) Notice: Subject to any disclaimer, the term of this patent is extended or adjusted under 35 U.S.C. 154(b) by 146 days.

(21) Appl. No.: 14/201,242

(22) Filed: Mar. 7, 2014

(65) Prior Publication Data

US 2014/0251102 A1 Sep. 11, 2014

(30) Foreign Application Priority Data

Mar. 8, 2013 (JP) ..... 2013-046539

(51) Int. Cl.

| | |
|---|---|
| ***B26F 1/14*** | (2006.01) |
| ***B26F 1/24*** | (2006.01) |
| ***B21D 28/34*** | (2006.01) |
| ***B21D 28/36*** | (2006.01) |
| *B26D 7/00* | (2006.01) |
| *B26D 5/00* | (2006.01) |

(52) U.S. Cl.

CPC . *B26F 1/24* (2013.01); *B21D 28/34* (2013.01); *B21D 28/36* (2013.01); *B26D 5/00* (2013.01); *B26D 2007/0012* (2013.01); *Y10T 83/05* (2015.04); *Y10T 83/8873* (2015.04)

(58) Field of Classification Search

CPC ..... B21D 28/34; B21D 28/36; B21D 28/246; B21D 28/26; B26D 2007/0012; B26D 5/00; B26F 1/24; B26F 1/04; Y10T 83/05; Y10T 83/8873; Y10T 83/943; Y10T 83/8727; Y10T 83/8867; Y10T 83/9423

USPC ..... 83/13, 34, 644, 16, 170, 543, 628, 213, 83/859, 627, 215, 746, 202, 682, 684, 685, 83/686, 687, 571, 216, 560, 556, 558, 551, 83/140, 143, 588, 635, 698, 305, 691; 270/5.02, 5.03, 21.1, 30.08, 52.17; 408/135, 153, 173, 87

See application file for complete search history.

(56) References Cited

U.S. PATENT DOCUMENTS

| | | | | |
|---|---|---|---|---|
| 2,622,682 A | | 12/1952 | Kopczynski | |
| 4,674,373 A | * | 6/1987 | Kuppinger | B23D 27/00 83/373 |
| 4,711,012 A | * | 12/1987 | Wolters | B21D 28/34 29/243.518 |
| 7,823,494 B2 | * | 11/2010 | Baba | B26D 5/16 408/135 |
| 2012/0111161 A1 | | 5/2012 | Kuriki et al. | |
| 2013/0104711 A1 | * | 5/2013 | Wu | B26F 1/02 83/34 |

FOREIGN PATENT DOCUMENTS

| | | |
|---|---|---|
| JP | U-61-58927 | 4/1986 |
| JP | 2002-331495 A | 11/2002 |
| JP | A-2003-19698 | 1/2003 |
| JP | A-2004-230517 | 8/2004 |
| JP | A-2008-137043 | 6/2008 |
| JP | 2012-101241 A | 5/2012 |
| JP | 2014-133249 A | 7/2014 |

OTHER PUBLICATIONS

Mar. 26, 2015 Office Action issued in Japanese Patent Application No. 2013-046539.

* cited by examiner

*Primary Examiner* — Ghassem Alie

(74) *Attorney, Agent, or Firm* — Oliff PLC

(57) ABSTRACT

A punching apparatus includes a holding part for holding a workpiece, a punch having a punching portion at an axial end thereof, the punching portion being configured to be inserted into the workpiece for punching the workpiece. The punching apparatus further includes a guide part supporting the punch so as to be movable in an axial direction of the punch, and a rotating part for rotating the punch around the axial direction of the punch while the punch is away from the workpiece.

3 Claims, 10 Drawing Sheets

PUNCHING APPARATUS AND PUNCHING METHOD

This application claims priority to Japanese Patent Application No. 2013-46539 filed on Mar. 8, 2013, the entire contents of which are hereby incorporated by reference.

BACKGROUND OF THE INVENTION

1. Field of the Invention

The present invention relates to an apparatus and a method for punching a workpiece.

2. Description of Related Art

There is known a punching apparatus for making a hole in a workpiece by inserting a punch into the workpiece. Japanese Patent Application Laid-open No. 2003-19698 describes a punching apparatus including two punches. When one of the two punches has been used and worn out at its punching portion, it is switched to the other one. Hence, according to this punching apparatus, the punch changing frequency can be reduced, and the continuous operation time can be prolonged.

Meanwhile, in the punching apparatus described in the above patent document, the punch is supported inside a guide hole formed in a guide member so as to be axially movable. There is a slight clearance between the inner wall of the guide hole and the punch to allow the punch to move in the guide hole. Accordingly, if the punch is inserted into a workpiece in a state of being slightly inclined to the direction vertical to the surface of the workpiece to be punched, it is likely that the circumferential edge of the end surface of the punching portion is abraded more at the side at which the punch is inserted into the workpiece more deeply. Accordingly, if a plurality of holes are punched successively in the workpiece using the punch in this state, the wear may develop rapidly at the end surface of the punching portion of the punch. In this case, there is a concern that, since a large bending moment is applied from the workpiece to the punching portion when the punching portion is inserted into the workpiece, a hole inclined to the direction vertical to the surface of the workpiece may be formed.

SUMMARY

An exemplary embodiment provides a punching apparatus including:

a holding part for holding a workpiece;

a punch including a punching portion at an axial end thereof, the punching portion being configured to be inserted into the workpiece for punching the workpiece;

a guide part supporting the punch so as to be movable in an axial direction of the punch; and a rotating part for rotating the punch around the axial direction of the punch while the punch is away from the workpiece.

The exemplary embodiment provides also a method of punching a workpiece including:

an installing step of fixing the workpiece;

a pressing step of moving a punch in an axial direction thereof to insert a punching portion thereof into the workpiece fixed by the installing step; and a rotating step of rotating the punch around the axial direction thereof while the workpiece is away from the punch, the rotating step being performed after the installing step and before the pressing step.

According to the exemplary embodiment, there are provided an apparatus and a method according to which a workpiece can be punched with a sufficiently small skew angle.

Other advantages and features of the invention will become apparent from the following description including the drawings and claims.

PREFERRED EMBODIMENTS OF THE INVENTION

First Embodiment

Figure 1:
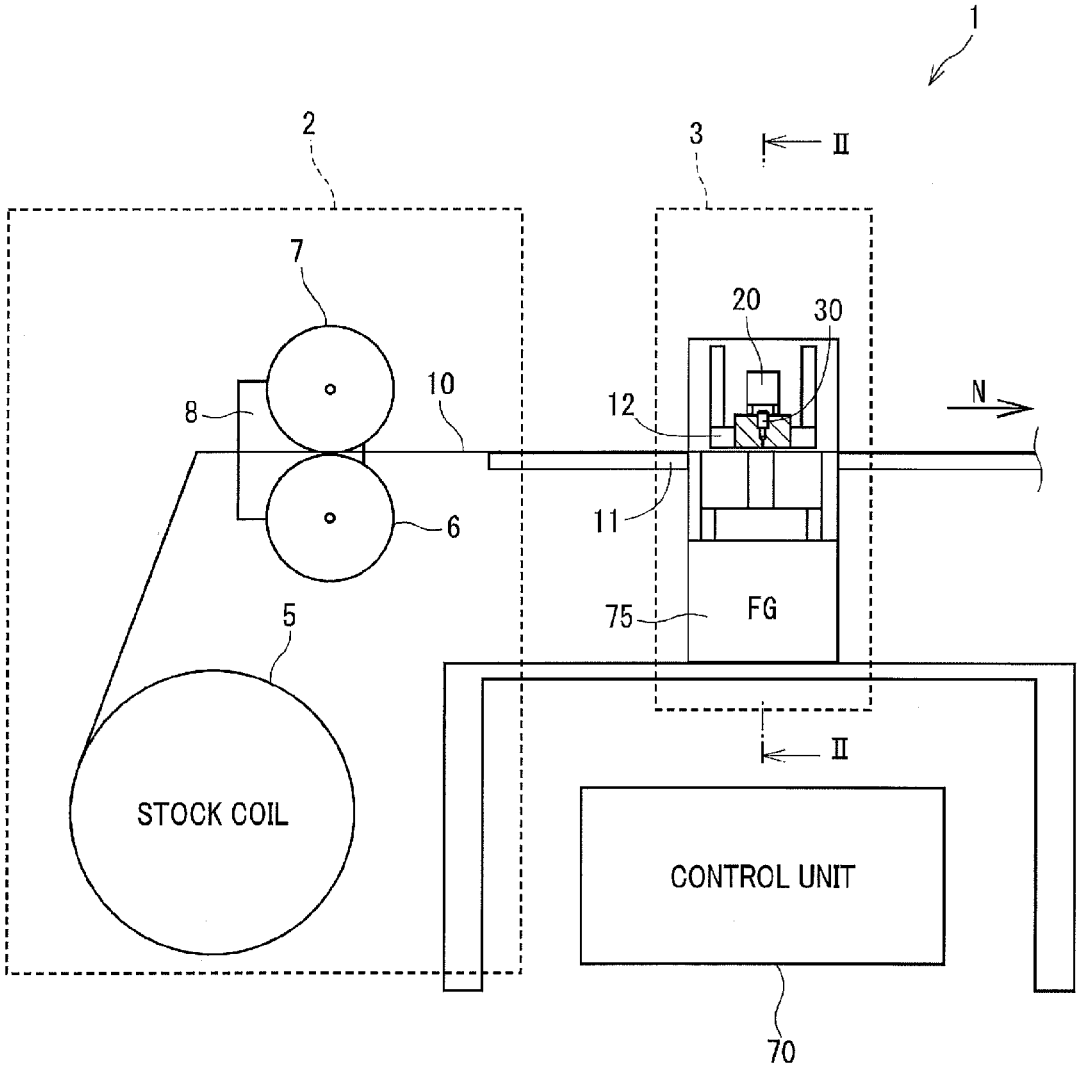
FIG. 1 is a schematic diagram of a punching apparatus according to an embodiment of the invention.

FIG. 1 is a schematic diagram of a punching apparatus 1 according to an embodiment of the invention. The punching apparatus 1 includes a material feeding section 2 and a punching section 3. The material feeding part 2 includes a stock coil 5, feed rollers 6 and 7 and a feed motor 8. The feed rollers 6 and 7 are driven by the feed motor 8 to transfer, as a workpiece 10, a metal plate unrolled from the stock coil 5 to the punching part 3. The arrow N in FIG. 1 shows the transfer direction of the workpiece 10.

The punching part 3 includes a lower die 11, an upper die 12, a press cylinder 20 and a punch 30. To punch a hole in the workpiece 10 held between the lower die 11 and the upper die 12, the press cylinder 20 moves the punch 30 toward the lower die 11 to insert the punch 30 into the workpiece 10. The lower die 11 and the upper die 12 constitute a holding part. The press cylinder constitutes a driving part.

Figure 2:
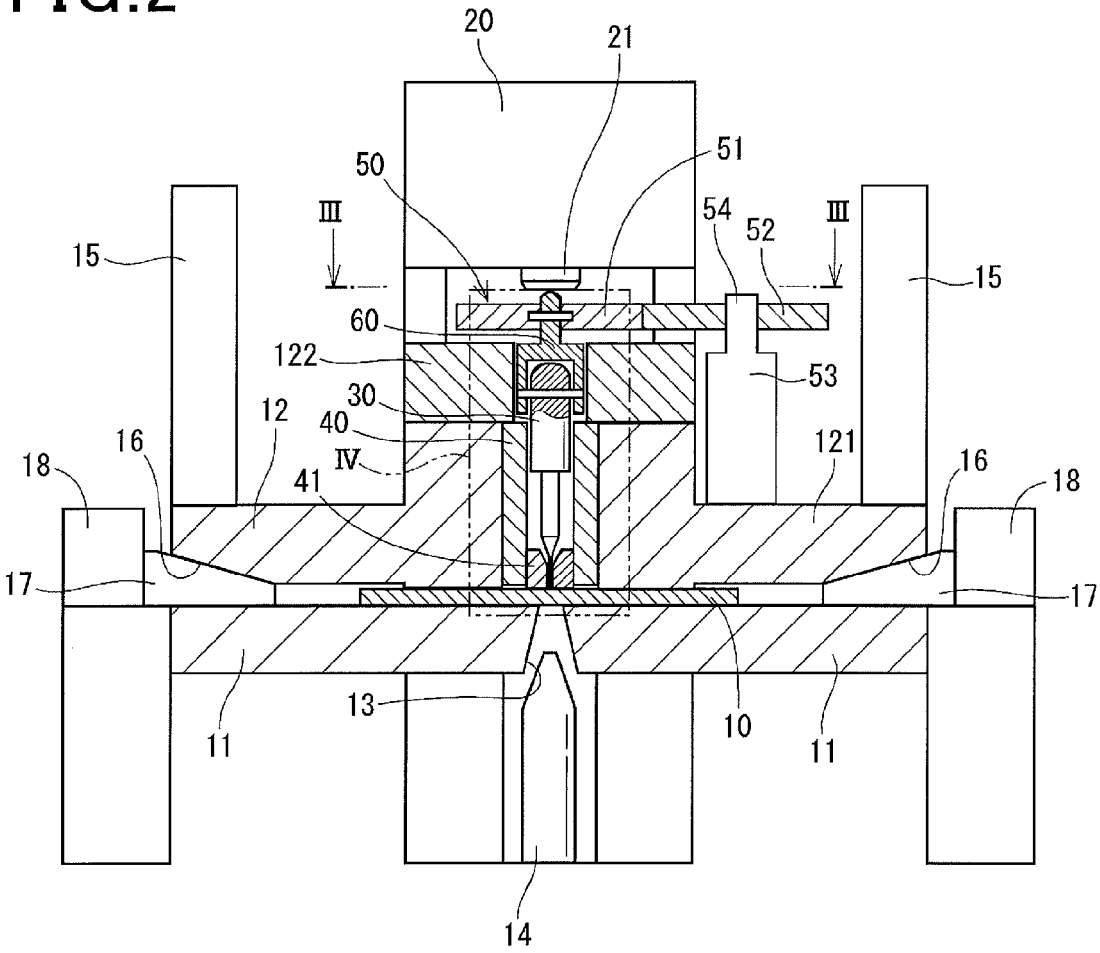
FIG. 2 is a cross-sectional view taken along line II-II in FIG. 1.
Figure 3:
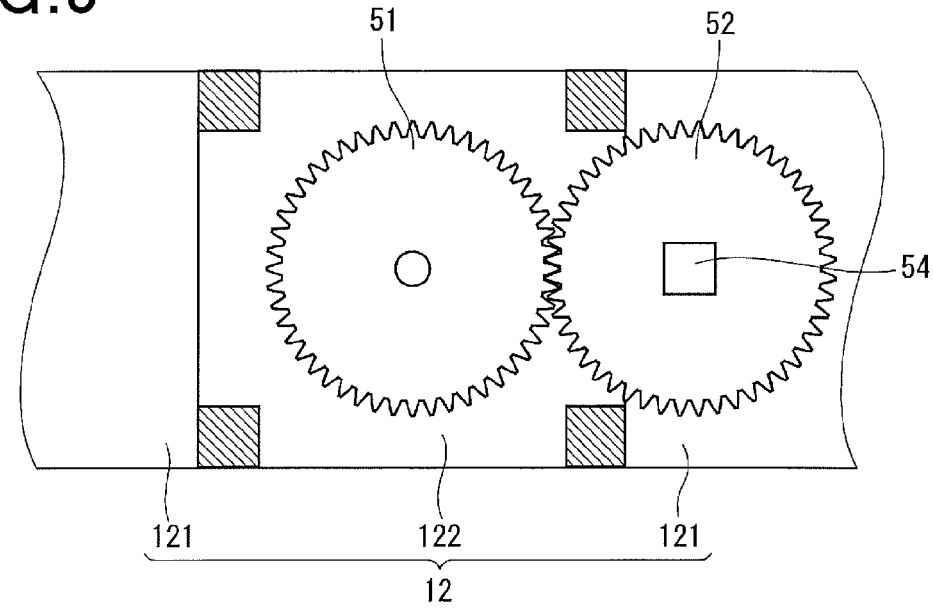
FIG. 3 is a cross-sectional view taken along line in FIG. 1.
Figure 4:
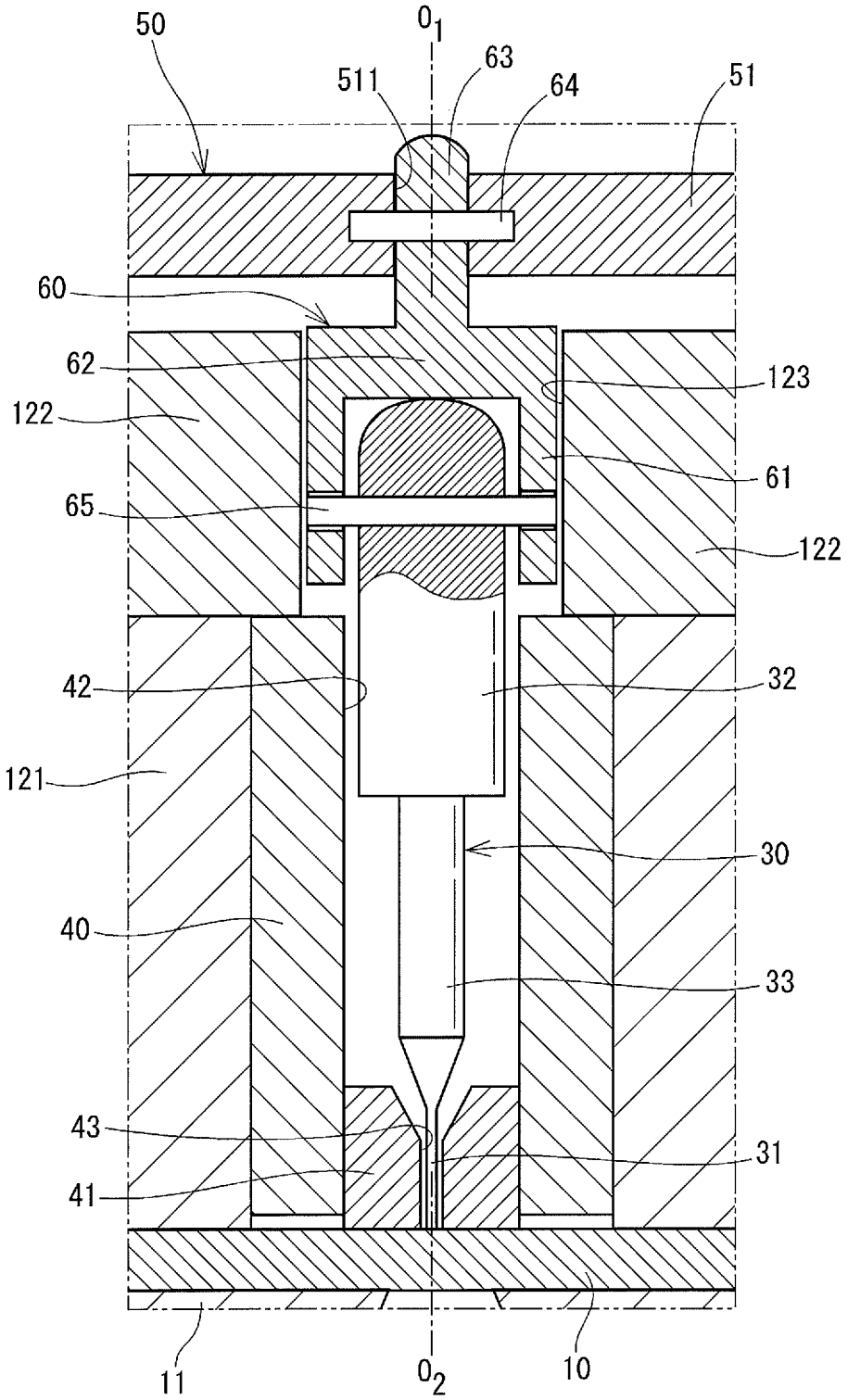
FIG. 4 is an enlarged view of a portion IV shown in FIG. 2.

As shown in FIGS. 2 to 4, the punching section 3 further includes a punch holder 40, a punching portion guide 41 and a rotating part 50. The punch holder 40 and the punching portion guide 41 constitute a guide part. The lower die 11 is formed with a hole 13 at a position at which a hole should be punched in the workpiece 10 placed on the lower die 11. A laser oscillator 14 is disposed as a heating part below the hole 13. The laser oscillator 14 applies laser light to the workpiece 10 through the hole 13 of the lower die 11 to heat the workpiece 10.

The upper die 12 is disposed movably relative to the lower die 11. The upper die 12 includes a first upper die member 121 and a second upper die member 122 disposed above the first upper die member 121. The first and second upper die members 121 and 122 are fixed to each other by bolts (not shown). A pressure cylinder 15 is disposed above the first upper die member 121. When the pressure cylinder 15 moves the first upper die member 121 downward, the first upper die member 121 presses the workpiece 10 toward the lower die 11. As a result, the workpiece 10 is held between the first upper die member 121 and the lower die 11. The first upper die member 121 is formed with a groove at each of its lateral sides, which is inclined downward toward the center thereof. A cam 17 is inserted into each of the grooves 16. When a cam cylinder 18 moves the cam 17 toward the center of the first upper die member 121, the first upper die member 121 moves upward to release the pressing force against the workpiece 10.

The punch 30 disposed inside the first and second upper die members 121 and 122 as shown in FIG. 4 is made of superhard material formed in a columnar shape. The punch 30 includes a punching portion 31, a shank portion 32 coaxial with the punching portion 31 and having a larger outer diameter than the punching portion 31, and a connecting portion 33 connecting the punching portion 31 to the shank portion 32. By inserting the punching portion 31 of the punch 30 into the workpiece 10, a hole having an inner diameter of 0.1 mm and a depth of 1.0 mm can be formed in the workpiece 10, for example.

The punch holder 40 has a cylindrical shape, and is fixed inside the first upper die member 121. The punch holder 40 is formed with a holder hole 42 for housing the shank portion 32 of the punch 30. The punching portion guide 41 is formed in a cylindrical shape and fixed inside the punch holder 40. The punching portion guide 40 is formed with a guide hole 43 for housing the punching portion 31 of the punch 30. The punch holder 40 and the punching portion guide 41 enable the punching portion 31 of the punch 30 to be guided into a position correctly at which the workpiece 10 should be punched. Between the inner wall of the holder hole 42 of the punch holder 40 and the shank portion 32, a clearance necessary for the shank portion 32 to move axially is provided. Between the inner wall of the guide hole 43 of the punching portion guide 41 and the punching portion 31, a clearance necessary for the punching portion 31 to move axially is provided. Since the outer diameter of the shank portion 32 is larger than that of the punching portion 31, the clearance between the inner wall of the holder hole 42 and the shank portion 32 is larger than the clearance between the inner wall of the guide hole 43 and the punching portion 31. Hence, the punch 30 is axially slidable relative to the punch holder 40 and the shank portion 32.

A coupling member 60 is disposed inside a cylindrical fitting hole 123 formed in the second upper die member 122. The coupling member 60 includes a barrel portion 61 located outside the shank portion 32, a bottom portion 62 closing one end of the barrel portion 61 and a shaft portion 63 extending toward the press cylinder 20. The shaft portion 63 passes through a center hole 511 formed in a later-described first gear 51 of the rotating part 50. Between the radially outer wall of the barrel portion 61 and the inner wall of the fitting hole 123 of the second upper die member 122, a clearance is provided to allow the coupling member 60 to axially rotate and move. The rotation axis of the coupling member 60 agrees with the center axis of the punching portion guide 41. Accordingly, the coupling member 60 can suppress axial offset between the rotation axis $O_1$ of the first gear 51 of the rotating part 50 and the center axis $O_2$ of the guide hole 43 of the punching portion guide 41.

The shaft portion 63 and the first gear 51 are connected to each other immovably relative to each other by a radially extending first pin 64. The barrel portion 61 and the shank portion 32 are connected to each other immovably relative to each other by a radially extending second pin 64. Accordingly, when the first gear 51 of the rotating part 50 rotates the shaft portion 63, this rotation is transmitted from the barrel portion 61 to the punch 30. The bottom portion 62 abuts against the shank portion 32. As shown in FIG. 2, a later-described actuating portion 21 of the press cylinder 20 can abut against the top surface of the shaft portion 63. Accordingly, when the actuating portion 21 of the press cylinder 20 presses the shaft portion 63, this pressing force is transmitted from the bottom portion 62 to the punch 30.

As shown in FIGS. 2 and 3, the rotating part 50 includes the first gear 51, a second gear 52 and a step motor 53. The first gear 51 is mounted at a position separated from the second upper die member 122 by a predetermined distance. The second gear 52 engages with the outer teeth of the first gear 51. The step motor 53 includes a shaft 54 fixed to the center hole of the second gear 52. The step motor 53 is mounted on the first upper die member 121. When the shaft 54 of the step motor 53 rotates, this rotation is transmitted to the punch 30 through the second gear 52, the first gear 51 and the coupling member 60. As a result, the punch 30 is axially rotated by the rotating part 50.

The press cylinder 20 provided in the second upper die member 122 includes an actuating portion 21 which is axially movable. When the actuating portion 21 of the press cylinder 20 presses the coupling member 60, this pressing force is transmitted from the coupling member 60 to the punch 30. As a result, the punching portion 31 of the punch 30 is inserted into the workpiece 10. When the press cylinder 20 presses the shaft portion 63 of the coupling member 60, the first gear 51 moves axially relative to the second gear 52.

Figure 5:
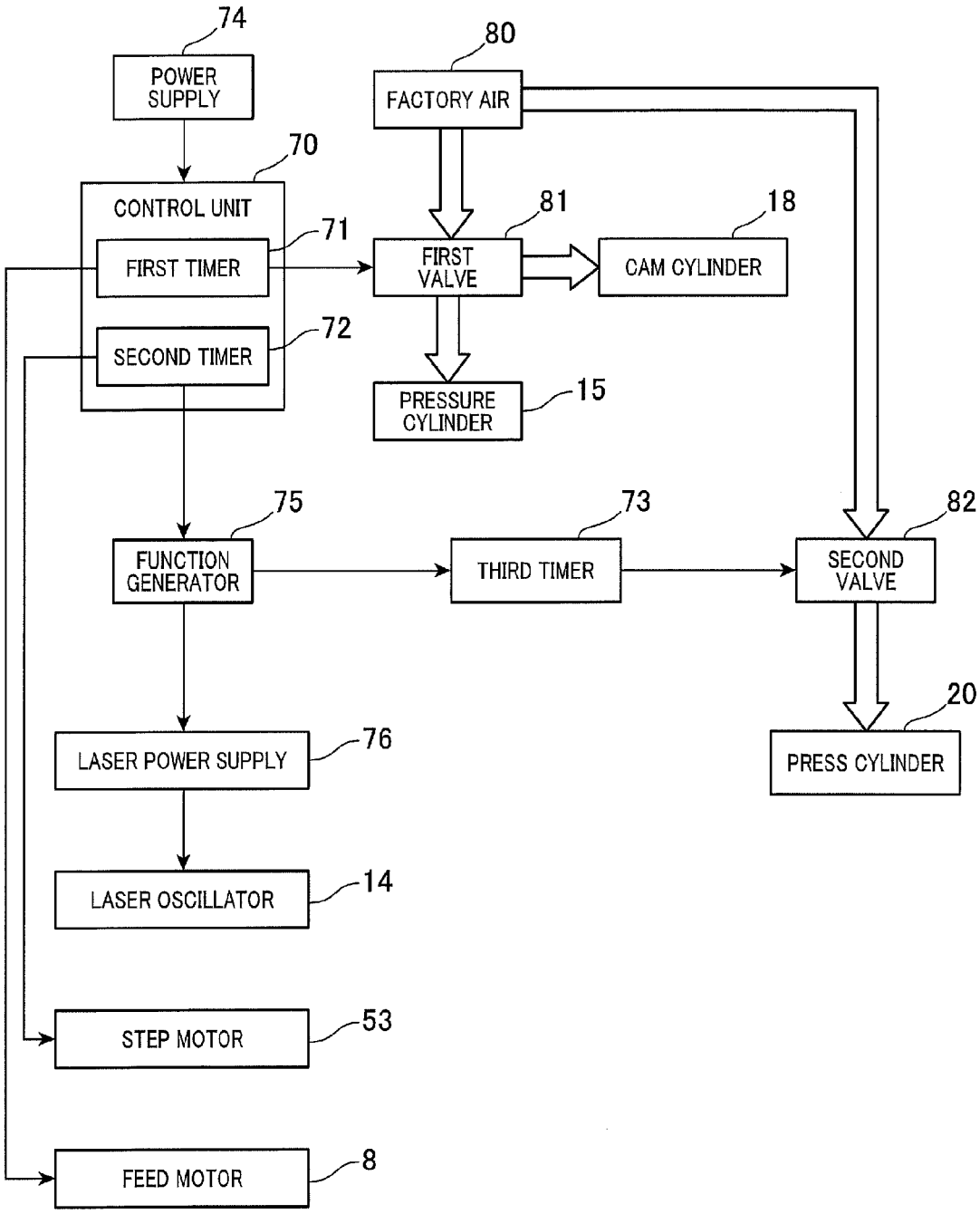
FIG. 5 is a block diagram of a punching system including the punching apparatus according to the embodiment of the invention.

Next, an example of a punching system including the punching apparatus 1 described above and installed in a factory is explained with reference to FIG. 5. Compressed air (factory air) 80 produced by a compressor installed in the factory is supplied to the pressure cylinder 15 for lowering the upper die 12 and the cam cylinder 18 for raising the upper die 12 through a first valve 81. The factory air 80 is also supplied to the press cylinder 20 for lowering the punch 30 through a second valve 82.

A control unit 70 includes a first timer 71, a second timer 72 and a third timer 73. When supplied with power from a power supply 74, the control unit 70 drives the first valve 81 and the feed motor 8 through the first timer 71, driving the step motor 53 of the rotating part 50 through the second timer 72, driving the laser oscillator 14 by controlling a laser power supply 76 through the second timer 72 using a function generator 75, and driving the second valve 82 through the second timer 72 using the function generator 75.

Figure 6:
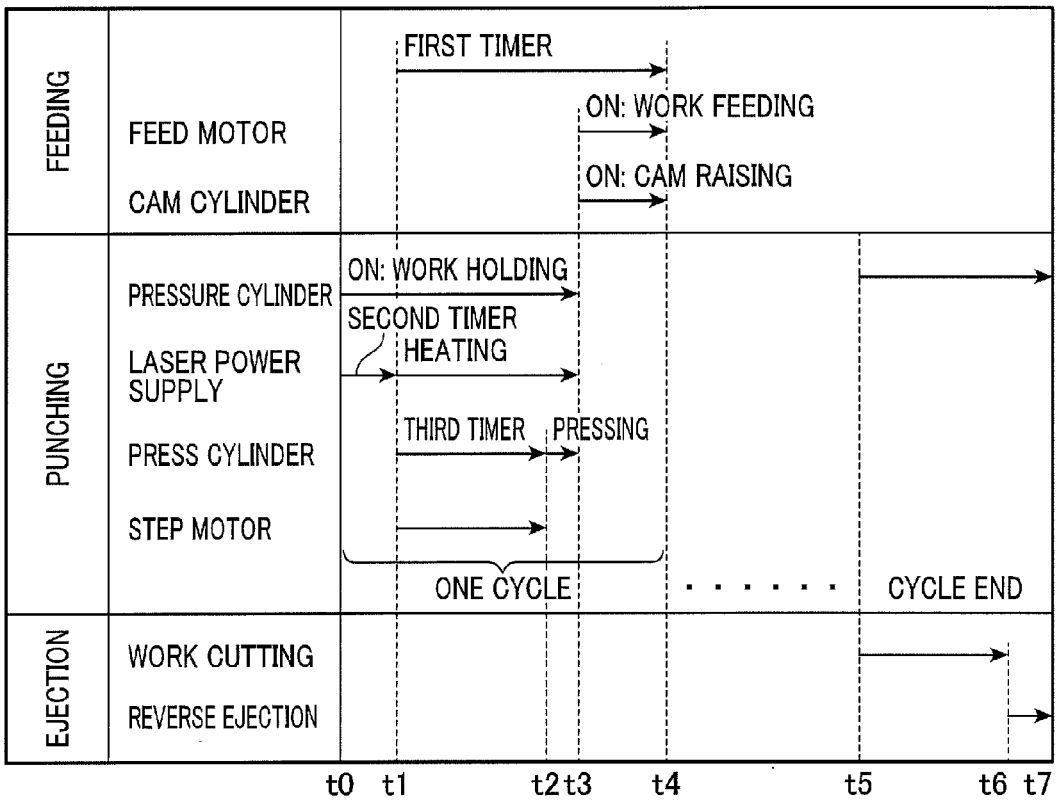
FIG. 6 is a time chart showing an operation of the punching apparatus according to the embodiment of the invention.

Next, a method of punching the workpiece 10 using the punching apparatus 1 is described with reference to FIG. 6. This method includes an installing step, a heating step, a rotating step and a pressing step. First, the feed motor 8 rotates the feed rollers 6 and 7 to transfer the workpiece 10 such that a portion to be punched is located between the lower die 11 and the upper die 12.

When the installing step is started at time t0, the pressure cylinder 15 lowers the first die member 121 so that the workpiece 10 is held between the first upper die member 121 and the lower die 11. After the first upper die member 121 is stopped, the heating step is started at time t1 in accordance with a signal outputted from the second timer 72. In this heating step, the laser power supply 76 is turned on, and the laser oscillator 14 applies laser light to the workpiece 10 to heat the workpiece 10. At time t2, the workpiece 10 is softened to such an extent that the load necessary to punch the workpiece 10 becomes smaller than the buckling load of the punch 30. Incidentally, a set temperature of the workpiece 10 to be achieved at this moment is lower than the melting point of the material of the workpiece 10.

When the temperature of the workpiece 10 reaches this set temperature at time t2, the second valve 82 is opened in accordance with a signal outputted from the third timer 73 to start the pressing step. In this pressing step, the actuating portion 21 of the press cylinder 20 presses the coupling member 60 to move the punch 30 axially. As a result, the punching portion 31 of the punch 30 is inserted into the workpiece 10. The rotating step is performed during a period from time t1 to time t2. The rotating step may be started at time t1 along with the heating step using the signal outputted from the second timer 72. In this rotating step, the step motor 53 of the rotating part 50 rotates to axially rotate the punch 30 by a predetermined angle. This predetermined angle may be any angle other than 360 degrees, for example, 180 degrees or 170 degrees. The rotating step is ended earlier than time t2 at which the pressing step is started.

After the pressing step is completed, the first valve 81 switches supply of the factory air 80 from the pressure cylinder 15 to the can cylinder 18 in accordance with the signal outputted from the first timer 71. As a result, the cam cylinder 18 is driven, and the first upper die member 121 releases the pressing force against the workpiece 10. Further, in accordance with the signal outputted from the first timer 71, the feed motor 8 rotates the feed rollers 6 and 7. As a result, a portion at which punching should be performed next is transferred between the lower die 11 and the upper die 12. When one punching cycle from time t0 to time t4 is completed, the workpiece 10 is formed with one hole. After that, the punching cycle is performed several times during a period from time t4 to t5 to form several holes in the workpiece 10. When the punching step is ended at time t5, the feed motor 8 rotates the feed rollers 6 and 7 to transfer the workpiece 10 formed with the holes to a material ejecting part (not shown).

Next, a comparison in perpendicular offset between the punching apparatus 1 of this embodiment and a punching apparatus according to a comparison example of the invention is explained with reference to FIGS. 7 to 14. The punching apparatus of this comparison example differs from the punching apparatus 1 only in that the rotating part is not provided. Here, the term "perpendicular offset" is a term indicating a degree of skew of a punched hole, more specifically, a positional offset from the center axis $O_2$ at a predetermined depth of the punched hole.

Figure 7:
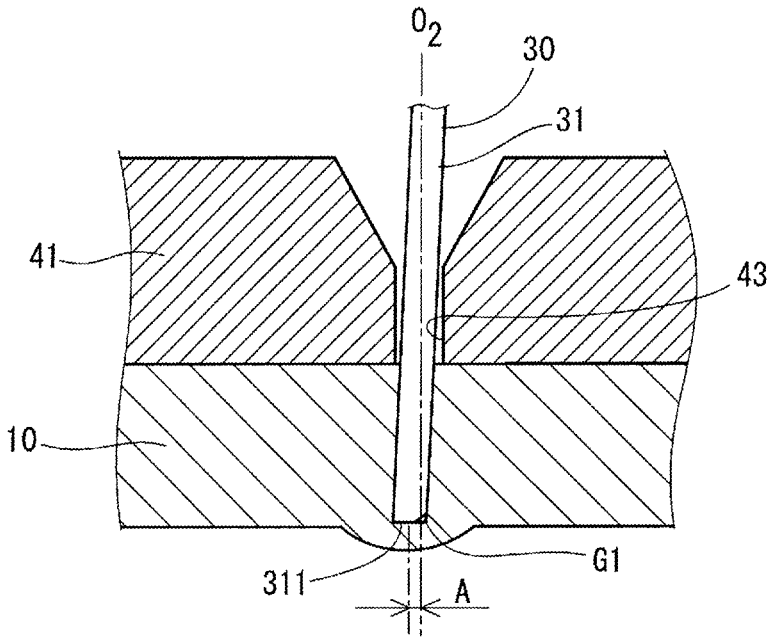
FIG. 7 is a cross-sectional view of main parts of the punching apparatus in operation according to the embodiment of the invention.
Figure 8:
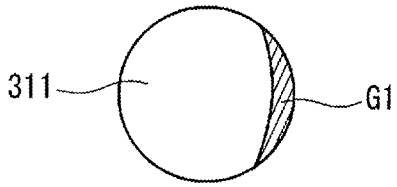
FIG. 8 is an enlarged view of the end surface of a punching portion of a punch shown in FIG. 7.

FIG. 7 shows a state where the punch 30 of the punching apparatus 1 is inserted into the workpiece 10 for the first time. FIG. 8 is a diagram schematically showing the end surface 311 of the punching portion 31 of the punch 30 at this moment. The punch 30 is supported by the inner wall of the guide hole 43 of the punching portion guide 41 and so on, however, it is slightly inclined to the vertical direction of the workpiece 10 because of the slight clearance to allow the punch 30 to slide axially. Accordingly, the circumferential edge of the end surface 311 of the punching portion 31 is abraded more due to friction with the material of the workpiece 10 at the side at which the punching portion 31 is inserted into the workpiece 10 more deeply. In FIG. 7, the perpendicular offset of the hole punched in the workpiece 10 for the first time is indicated by A. In FIGS. 7 and 8, the abraded portion formed by the punching is indicated by G1.

Figure 9:
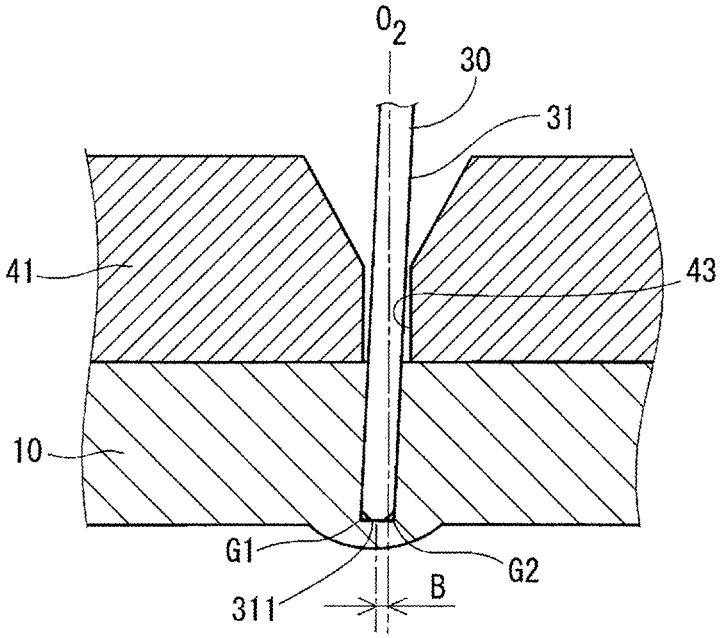
FIG. 9 is a cross-sectional view of the main parts of the punching apparatus in operation according to the embodiment of the invention.
Figure 10:
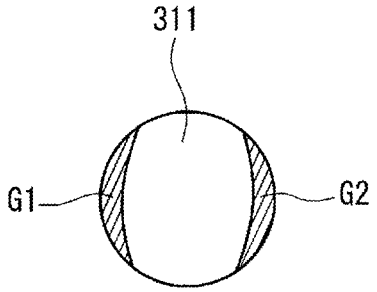
FIG. 10 is an enlarged view of the end surface of the punching portion of the punch shown in FIG. 9.

FIG. 9 shows a state where the punch 30 of the punching apparatus 1 is inserted into the workpiece 10 for the second time. FIG. 10 is a diagram schematically showing the end surface 311 of the punching portion 31 of the punch 30 at this moment. The direction of inclination of the punch 30 being inserted into the workpiece 10 is the same at that shown in FIG. 7, because it depends on the clearance with the inner wall of the guide hole 43 and so on. However, prior to being inserted into the workpiece 10, the punch 30 is rotated by a predetermined angle (180 degrees, for example) by the rotating part 50 after it was inserted into the workpiece 10 for the first time. Accordingly, the abraded portion G2 formed by the second punching in the end surface 311 of the punching portion 31 is 180-degree opposite to the abraded portion G1 formed by the first punching. Hence, the bending moment applied from the material of the workpiece 10 to the punching portion 31 of the punch 30 can be reduced, and the perpendicular offset of the hole punched by the second punching can be made approximately the same as that of the hole punched by the first punching. In FIG. 9, the perpendicular offset of the hole punched in the workpiece 10 by the second or following punching is indicated by B.

Figure 11:
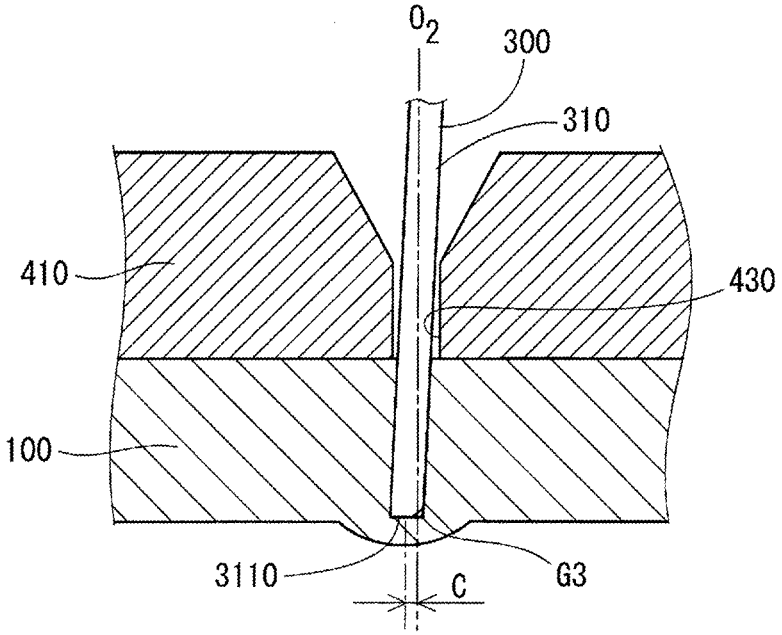
FIG. 11 is a cross-sectional view of main parts of a punching apparatus in operation according to a comparative example of the invention.
Figure 12:
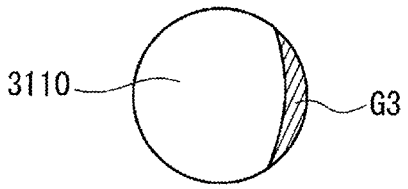
FIG. 12 is an enlarged view of the end surface of a punching portion of a punch shown in FIG. 11.

FIG. 11 shows a state where a punch 300 of the punching apparatus according to the comparative example of the invention is inserted into a workpiece 100 for the first time. FIG. 12 is a diagram schematically showing the end surface 311 of a punching portion 310 of the punch 300 at this moment. Also in this punching apparatus of this comparative example, the punch 300 is inserted into the workpiece 100 in a state of being slightly inclined to the vertical direction of the workpiece 100 because of slight clearance with the inner wall of a guide hole 430 necessary for the punch 300 to slide axially. Accordingly, the circumferential edge of the end surface 3110 of the punching portion 310 is abraded more due to friction with the material of the workpiece 100 at the side at which the punching portion 300 is inserted into the workpiece 100 more deeply. In FIG. 11, the perpendicular offset of the hole punched in the workpiece 100 for the first time is indicated by C. In FIGS. 11 and 12, the abraded portion is indicated by G3.

Figure 13:
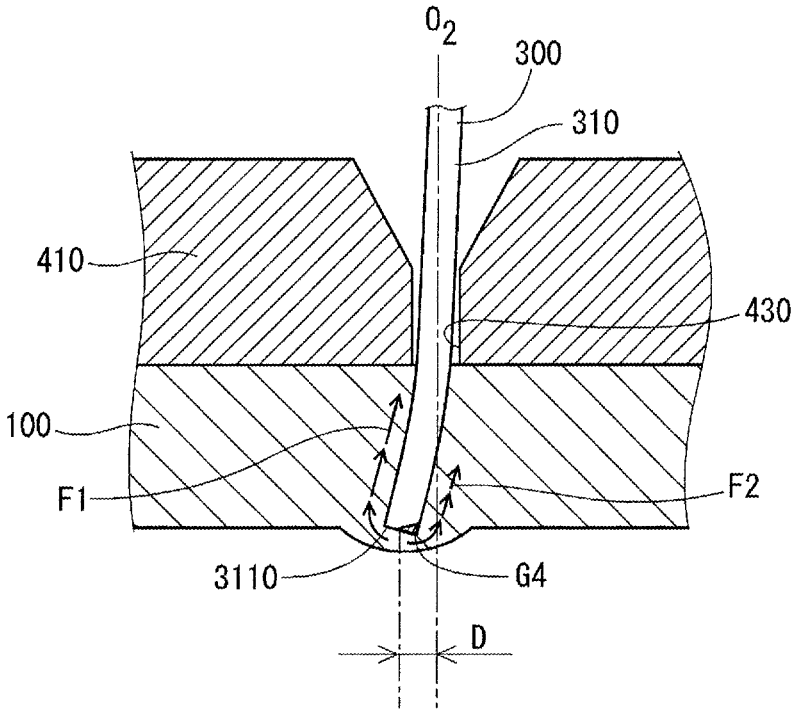
FIG. 13 is a cross-sectional view of the main parts of the punching apparatus in operation according to the comparative example of the invention.
Figure 14:
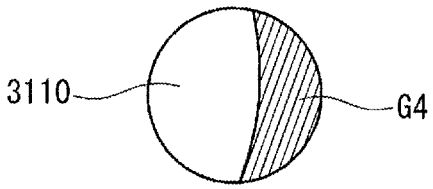
FIG. 14 is an enlarged view of the end surface of a punching portion of a punch shown in FIG. 13.

FIG. 13 is a diagram showing a state where the punch 300 of the punching apparatus of the comparative example has been inserted into the workpiece 100 for the second or following time. FIG. 14 is a diagram schematically showing the end surface 311 of the punching portion 310 of the punch 300 at this moment. In FIG. 14 the abraded portion is indicated by G4. The abraded portion G4 is formed at the same position in the end surface 3110 of the punching portion 310 as that of the abraded portion G3 which was formed by the first punching. Accordingly, the abraded portion G4 is larger than the abraded portion G3. Accordingly, as shown by the arrows F1 and F2 in FIG. 13, unevenness in the material flow of the workpiece 100 becomes significant around the punching portion 310 of the punch 300. Hence, the bending moment applied from the material of the workpiece 100 to the punching portion 310 of the punch 300 increases, causing the punching portion 310 to bend gradually. In FIG. 13, the perpendicular offset of the hole punched in the workpiece 100 by the second or following punching is indicated by D.

The perpendicularity offset D of the hole punched by the second or following punching is larger than the perpendicular offset C of the hole punched by the first punching.

Figure 15:
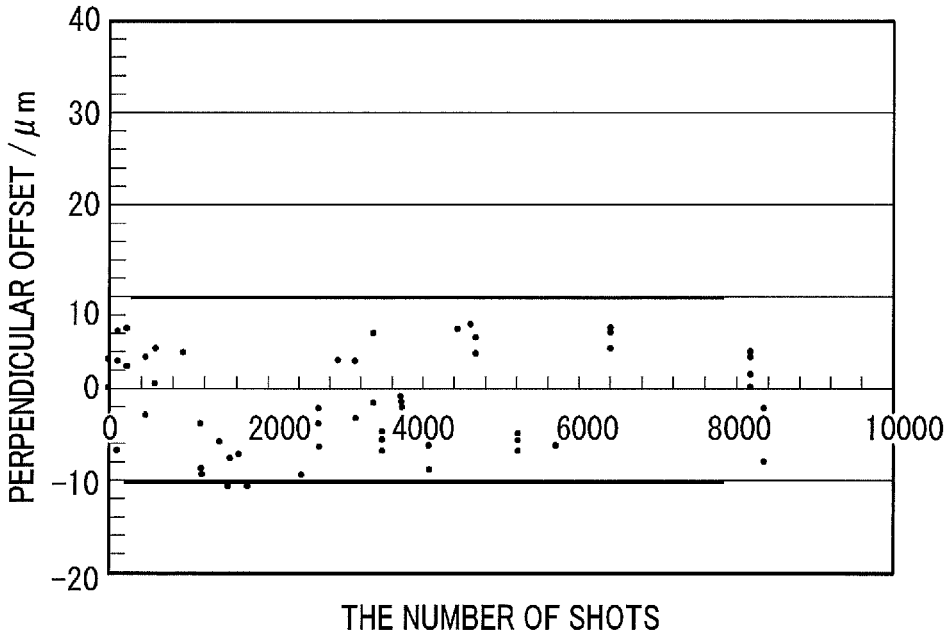
FIG. 15 is a diagram showing measured results of perpendicular offset of holes punched by the punching apparatus according to the embodiment of the invention.
Figure 16:
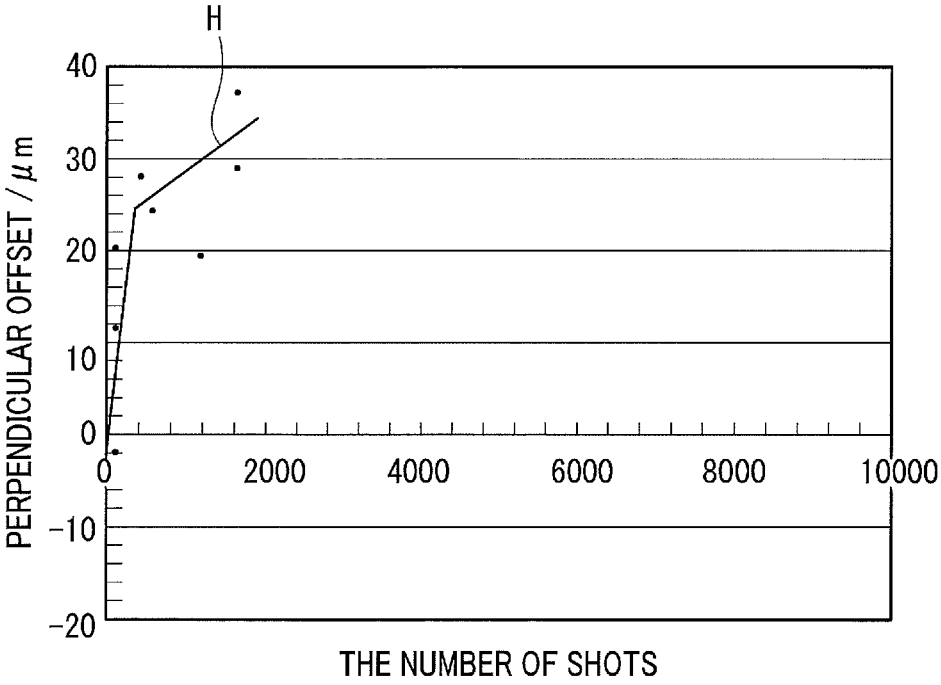
FIG. 16 is a diagram showing measured results of perpendicular offset of holes punched by the punching apparatus according to the comparative example of the invention.

FIG. 15 is a diagram showing measured results of the perpendicular offsets of the holes made by the punching apparatus 1 according to the embodiment of the invention. FIG. 16 is a diagram showing measured results of the perpendicular offsets of the holes made by the punching apparatus according to the comparative example of the invention. As indicated by the broken line H in FIG. 16, the perpendicular offsets of the holes made by the punching apparatus of the comparative example increase with the increase of the number of shots. On the other hand, as seen from FIG. 15, the perpendicular offsets of the holes made by the punching apparatus 1 of this embodiment are within a certain range (+10 to −10 μm in this example) and are independent of the number of shots. As understood from the above measurements, according to the punching apparatus 1 of this embodiment, the perpendicular skews (offsets) of the punched holes can be reduced.

The embodiment described above provides the following advantages.

(1) The rotating part 50 axially rotates the punch 30 while it is separated from the workpiece 10 so that the end surface 311 of the punching portion 31 is abraded uniformly along the circumferential direction while the workpiece 10 is punched with a plurality of holes by inserting the punching portion 31 into the workpiece 10 several times. Accordingly, since the bending moment applied from the material of the workpiece 10 to the punching portion 31 of the punch 30 can be reduced, the perpendicular offsets (skews) of the holes formed by the second and following punchings can be reduced.

(2) The rotating part 50 is disposed above the upper die 12, and moves in the axial direction of the punch 30 together with the upper die 12 to reduce the positional deviation between the rotating part 50 and the punch 30. Accordingly, the rotating part 50 can rotate the punch 30 around the center axis of the guide hole 43 of the punching portion guide 41. This makes is possible to prevent the punch 30 from being broken.

(3) The punch 30 includes the punching portion 31 at its axial end, and the shank portion 32 whose diameter is larger than that of the punching portion 31. Accordingly, the punching portion 31 can be made small in diameter, while enabling transmission of the pressing force necessary to insert the punching portion 31 into the workpiece 10 from the shank portion 32 to the punching portion 31.

(4) The punch holder 40 supporting the shank portion 32 and the punching portion guide 41 supporting the punching portion 31 constitute the guide part. The guide part enables the punch 30 to be inserted into the workpiece 10 at a correct position.

(5) The coupling member 60 disposed between the second upper die member 122 and the shank portion 32 transmits the torque of the rotating part 50 to the punch 30.

If the punching apparatus 1 is not provided with the coupling member 60, it may occur that the rotation axis $O_1$ of the first gear 51 of the rotating part 50 and the center axis $O_2$ of the guide hole 43 of the punching portion guide 41 are out of alignment with each other, as a result of which the connecting portion 33 of the punch 30 is applied with a tensile stress. In this embodiment, the punching apparatus 1 includes the coupling member 60. This makes it possible to suppress axial deviation between the rotation axis $O_1$ of the first gear 51 of the rotating part 50 and the center axis $O_2$ of the guide hole 43 of the punching portion guide 41, and to absorb swing or positional deviation of the punch 30 by the clearance between the coupling member 60 and the shank portion 32 or the second pin 65. Accordingly, the tensile stress radially applied to the punch 30 can be reduced to prevent the punch 30 from being bent or broken.

(6) The coupling member 60 is rotatably disposed inside the fitting hole 123 of the second upper die member 122, and suppresses axial deviation between the rotation axis $O_1$ of the first gear 51 of the rotating part 50 and the center axis $O_2$ of the guide hole 43 of the punching portion guide 41. Accordingly, swing or positional deviation of the punch 30 due to rotation of the first gear 51 of the rotating part 50 can be reduced to thereby suppress the punch 30 from being bent or broken.

(7) The shaft portion 63 of the coupling member 60 penetrates through the center hole 511 of the first gear 51 of the rotating part 50 and is capable of abutting against the actuating portion 21 of the press cylinder 20 to transmit the pressing force of the press cylinder 20 to the punch 30. Accordingly, since the reaction force of the punch 30 against the pressing force of the press cylinder 20 is not transmitted to the first gear 51 of the rotating part 50, the first gear 51 can be prevented from being broken or positionally deviated.

(8) The punching method of this embodiment includes the rotating step of axially rotating the punch 30 between the installing step and the pressing step. If the punch 30 is rotated during the pressing step, the punching portion 31 may be broken or bent because of the stress applied from the workpiece 10 to the punching portion 31. If the punch 30 is rotated during the installing step, the punching portion 31 may be broken or bent because of the interference between the punching portion guide 41 and the punching portion 31 due to vibration. By rotating the punch 30 after the installing step and before the pressing step, the punching portion 31 can be prevented from being broken and suppressed from being bent relative to the vertical direction.

Other Embodiments

In the above embodiment, the first upper die member 121, the second upper die member 122, the punch holder 40 and the punching portion guide 41 are separate components. However, they may be formed integrally.

The punching apparatus 1 of the above embodiment includes the laser oscillator 14. However, if the punch is used in a range (punching depth and punching diameter) where there is no concern that the punch will buckle, the laser oscillator 14 may be omitted.

In the above embodiment, the press cylinder 20 is provided in the second upper die member 122. However, the press cylinder 20 may be provided in the first upper die member 121, or in the lower die 11. The press cylinder 20 may be omitted, if the punch 30 is driven by other than the press cylinder 20, for example, by the pressure cylinder 15.

In the above embodiment, the holding part is configured to hold the workpiece 10 between the first upper die member 121 and the lower die 11. However, the holding part may be such as to clamp the workpiece 10 from both sides, if the warp of the workpiece 10 is within an acceptable range.

In the above embodiment, the punch 30 includes the punching portion 31, the shank portion 32 and the connecting portion 33. However, the punch 30 may be formed in a shape having a diameter constant along the axial direction, if the rigidity thereof is high enough to prevent the punch 30 from buckling during punching. In this case, the punch holder 40 and the punching portion guide 41 may be formed integrally as the guide part. If the diameter of the punch 30 is constant along the axial direction, and the axial positional deviation due to the first gear 51 of the rotating part 50 is small, the coupling member 60 may be omitted.

In the above embodiment, the shaft portion 63 of the coupling member 60 and the center hole 511 of the first gear 51 are connected to each other by the first pin 64. However, the first pin 64 may be omitted if the cross section of the shaft portion 63 of the coupling member 60 is noncircular, and the cross section of the center hole of the first gear 51 is noncircular corresponding to the cross section of the shaft portion 63.

In the above embodiment, the shank portion 32 of the punch 30 and the barrel portion 61 of the coupling member 60 are connected to each other by the second pin 65. However, the second pin 65 may be omitted if the cross section of the head of the shank portion 32 of the punch 30 is noncircular, and the cross section of the barrel portion 61 of the coupling member 60 is noncircular corresponding to the cross section of the head of shank portion 32.

In the above embodiment, the rotating part 50 rotates the punch 30 each time a hole is punched. However, the rotating part 50 may be configured to rotate the punch 30 each time a plurality of holes are punched.

In the above embodiment, each of the press cylinder 20, the pressure cylinder 15 and the cam cylinder 18 is an air cylinder. However, the press cylinder 20 may be an electric press, and each of the pressure cylinder 15 and the cam cylinder 18 may be an electric actuator.

The above explained preferred embodiments are exemplary of the invention of the present application which is described solely by the claims appended below. It should be understood that modifications of the preferred embodiments may be made as would occur to one of skill in the art.

What is claimed is:

1. A punching apparatus comprising:

a holding part for holding a workpiece, the holding part including a lower die for placing the workpiece thereon and an upper die for pressing the workpiece against the lower die;

a punch including a punching portion at an axial end thereof and a shank portion, the punching portion being configured to be inserted into the workpiece for punching the workpiece, the shank portion being coaxial with the punching portion and having a larger outer diameter than the punching portion;

a guide part supporting the punch so as to be movable in an axial direction of the punch, the guide part including a punch holder and a punching portion guide, the punch holder having a holder hole for supporting the shank portion movably in the axial direction, the punching portion guide having a guide hole for supporting the punching portion movably in the axial direction;

a rotating part for rotating the punch around the axial direction of the punch while the punch is away from the workpiece; and a coupling member disposed inside a fitting hole formed in the upper die so as to be rotatable around the axial direction, to support the shank portion and to transmit torque of the rotating part to the punch, the coupling member including a barrel portion disposed outside the shank portion, a bottom portion, and a shaft portion extending from the bottom portion toward a driving part for moving the punch toward the lower die;

wherein the rotating part and the guide part are provided in the upper die so as to be movable in the axial direction of the punch together with the upper die.

2. The punching apparatus according to claim 1, wherein the coupling member suppresses axial deviation between a rotation axis of the rotating part and a center axis of the guide hole of the punching portion guide.

3. The punching apparatus according to claim 1, wherein the coupling member is capable of abutting against the driving part penetrating through the rotating part to transmit a pressing force from the driving part to the punch.

* * * * *